United States Patent [19]

Hoffman

[11] 3,992,821

[45] Nov. 23, 1976

[54] GEM FACETING MACHINE HAVING AN ADJUSTABLE FACETING HEAD SUPPORT ASSEMBLY

[76] Inventor: Douglas L. Hoffman, 3507 LaCrosse, Spokane, Wash. 99205

[22] Filed: June 6, 1975

[21] Appl. No.: 584,507

[52] U.S. Cl. ..... 51/125; 51/229; 74/424.8 A

[51] Int. Cl.[2] ..... B24B 9/16

[58] Field of Search ..... 51/229, 125; 74/424.8 A

[56] References Cited

UNITED STATES PATENTS

| | | | |
|---|---|---|---|
| 357,567 | 2/1887 | Barnes | 74/424.8 A |
| 1,467,039 | 9/1923 | Hume | 74/424.8 A |
| 3,818,641 | 6/1974 | Long | 51/229 |

FOREIGN PATENTS OR APPLICATIONS

| | | | |
|---|---|---|---|
| 104,305 | 7/1874 | France | 51/229 |

*Primary Examiner*—Harold D. Whitehead
*Attorney, Agent, or Firm*—Wells, St. John & Roberts

[57] ABSTRACT

An adjustable faceting head support assembly having an upright mast with a longitudinal open groove that receives an elongated vertical lead screw. The lead screw is mounted within the groove about an axis parallel to the axis of the mast. A collar assembly encompasses the lead screw and mast for longitudinal sliding movement along the mast. A half nut mechanism provided on the collar enables selective engagement and disengagement with the lead screw. An adjusting knob at an upper end of the lead screw allows for precise rotation of the lead screw to locate the faceting head at a precise position with respect to a lap surface when the half nut is engaged with the lead screw. When the half nut is disengaged from the lead screw, the faceting head may be moved freely along the mast axis, permitting one to quickly position the faceting head over the lap.

8 Claims, 5 Drawing Figures

FIG 2
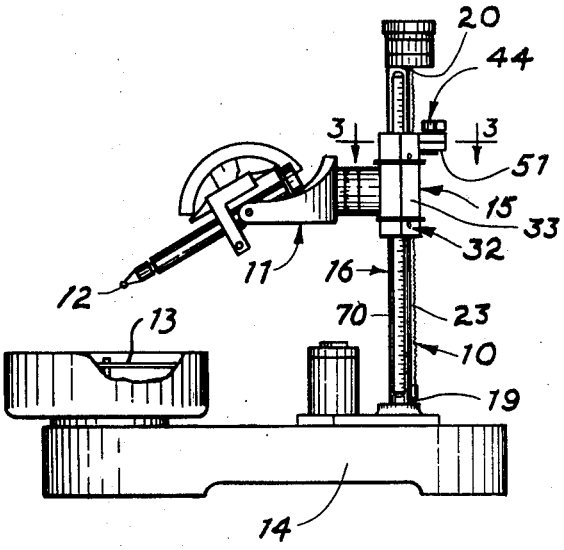
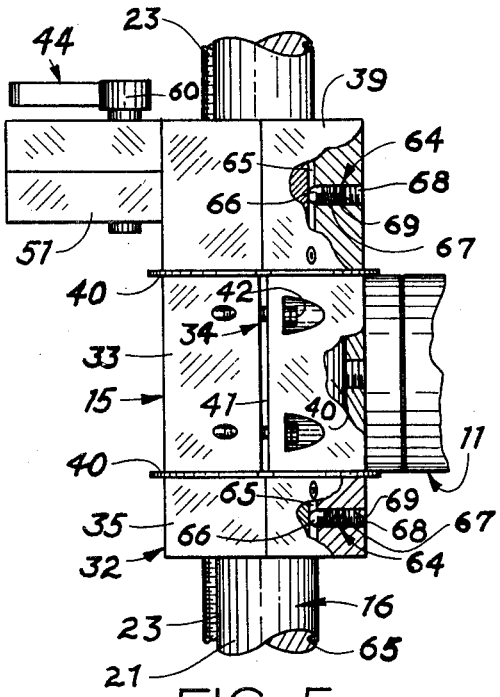
FIG 5
FIG 3
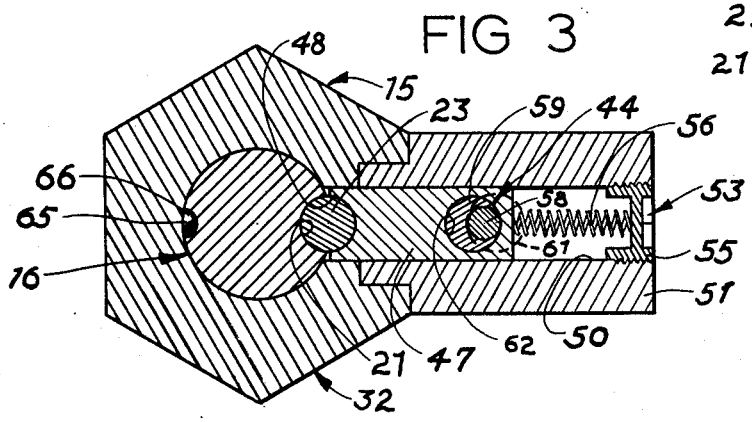
FIG 4
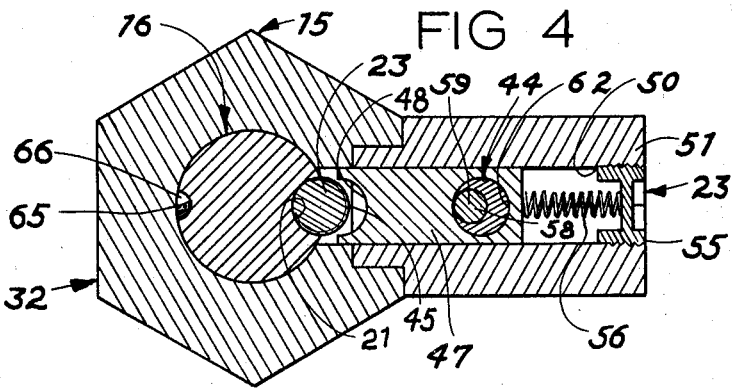

GEM FACETING MACHINE HAVING AN ADJUSTABLE FACETING HEAD SUPPORT ASSEMBLY

BACKGROUND OF THE INVENTION

The present invention relates to the general field of gem faceting apparatus and more specifically to such apparatus utilizing a vertically adjustable faceting head support assembly for elevationally locating the attached gem at a selected elevation relative to a lap surface.

Gem faceting machines are utilized to cut or polish facets in precious or semi-precious stones. Such a machine is disclosed in U.S. Pat. No. 3,815,289 which is also directed toward a gem faceting machine having an adjustable faceting head support assembly. Such faceting machines generally include a powered "lap" or grinding wheel for rotation about a vertical axis in a fixed horizontal place. The gem is held by a "faceting head" including a "dop" elevationally adjacent the lap at one end of a "dop arm". It is generally desirable to angularly and elevationally position the gem relative to the lap surface. This procedure is accomplished by an angle adjusting mechanism associated with the dop arm and an adjustable elevational support for the faceting head. The present invention is concerned primarily with such supports, utilized in conjunction with gem faceting apparatus.

The dop and dop arm are ordinarily positioned by a support yoke and are elevationally positionable by adjustment of a support frame slidably mounted to a vertical support or mast. Fine elevational adjustments are conventionally controlled by a separate adjusting screw assembly provided between the yoke and dop arm. Horizontal pivotal movement of the dop arm is usually centered about the axis of a secondary shaft spaced laterally of the central axis of the supporting mast.

The primary disadvantage of the above described apparatus is that the pivotal movement of the faceting head requires more than one vertical axis. This presents a possibility of compounding several errors within normal tolerance limits. Further, this type of assembly requires that the dop be supported a substantial distance from the support shaft, creating more likelihood that the support shaft will deflect or bend as leverage is applied at the end of the dop arm.

Apparatus disclosed in my prior U.S. Pat. No. 3,815,289 serves to eliminate the disadvantages discussed above. This apparatus utilizes a pivotable rack and gear assembly for precisely positioning the dop arm elevationally relative to a lap surface and for enabling pivotal movement of the dop arm about the axis of the supporting mast. The present invention is comprised of an improved faceting head support wherein the vertical adjustment and pivot arrangement of the dop support mechanism is more simply constructed and eliminates, to a substantial degree, backlash between the faceting head support and vertical adjusting assembly.

SUMMARY OF THE INVENTION

An improved adjustable faceting head support assembly is described in combination with a gem faceting apparatus having a base and a powered horizontal lap rotatably mounted on the base and with a faceting head located above the lap. The improvement in the adjustable faceting head support assembly comprises an upright mast of generally circular cross section extending along a central axis and having a longitudinal open groove formed therein parallel to said central axis. An elongated lead screw is loosely received within the groove for rotation therein about an axis parallel to the central axis of the mast. A collar means is provided that encompasses a longitudinal portion of the mast and lead screw for free sliding movement thereon along the central axis of the mast. A faceting head mounting sleeve also encompasses the mast and lead screw and is supported by the collar means for free rotation thereon about the mast and lead screw. Included within the collar means is a half nut means mounted for lateral movement thereon relative to the lead screw. The half nut means is movable between a first position threadably engaging the lead screw to enable sliding movement of the collar means and faceting head mounting sleeve along the central axis only in response to rotation of the lead screw about its axis, and a second position disengaged from the lead screw to enable free sliding movement of the collar means and faceting head mounting sleeve along the central axis over the mast and lead screw. Actuator means is provided that operatively engages the half nut means to enable selective engagement of the lead screw and half nut means. Further, means is provided for rotating the lead screw to locate the faceting head elevationally over the lap when the half nut means is engaged with the lead screw.

It is a first object of the present invention to provide an adjustable faceting head support assembly in combination with a gem faceting apparatus that enables accurate elevational positioning of a gem above a lap surface while enabling pivotal movement thereof about a vertical axis.

It is a further object to provide such an assembly that is relatively simple in construction and therefore inexpensive to purchase and maintain.

It is a yet further object to provide such an assembly wherein backlash between the faceting head and support base is held at a minimum.

These and further objects and advantages of the present improvement will become evident upon reading the following description which, taken with the accompanying drawings, describe a preferred form of my invention.

BRIEF DESCRIPTION OF THE DRAWINGS

FIG. 2 is a reduced diagrammatic view of a faceting machine incorporating the present invention;

FIG. 3 is an enlarged sectional view taken along line 3—3 in FIG. 2;

FIG. 4 is a sectional view similar to FIG. 3 only showing a different operational position of the elements therein; and FIG. 5 is a fragmentary enlarged rear elevation view of my improved faceting head support as seen from behind in FIG. 2.

DETAILED DESCRIPTION OF A PREFERRED EMBODIMENT

Figure 1:
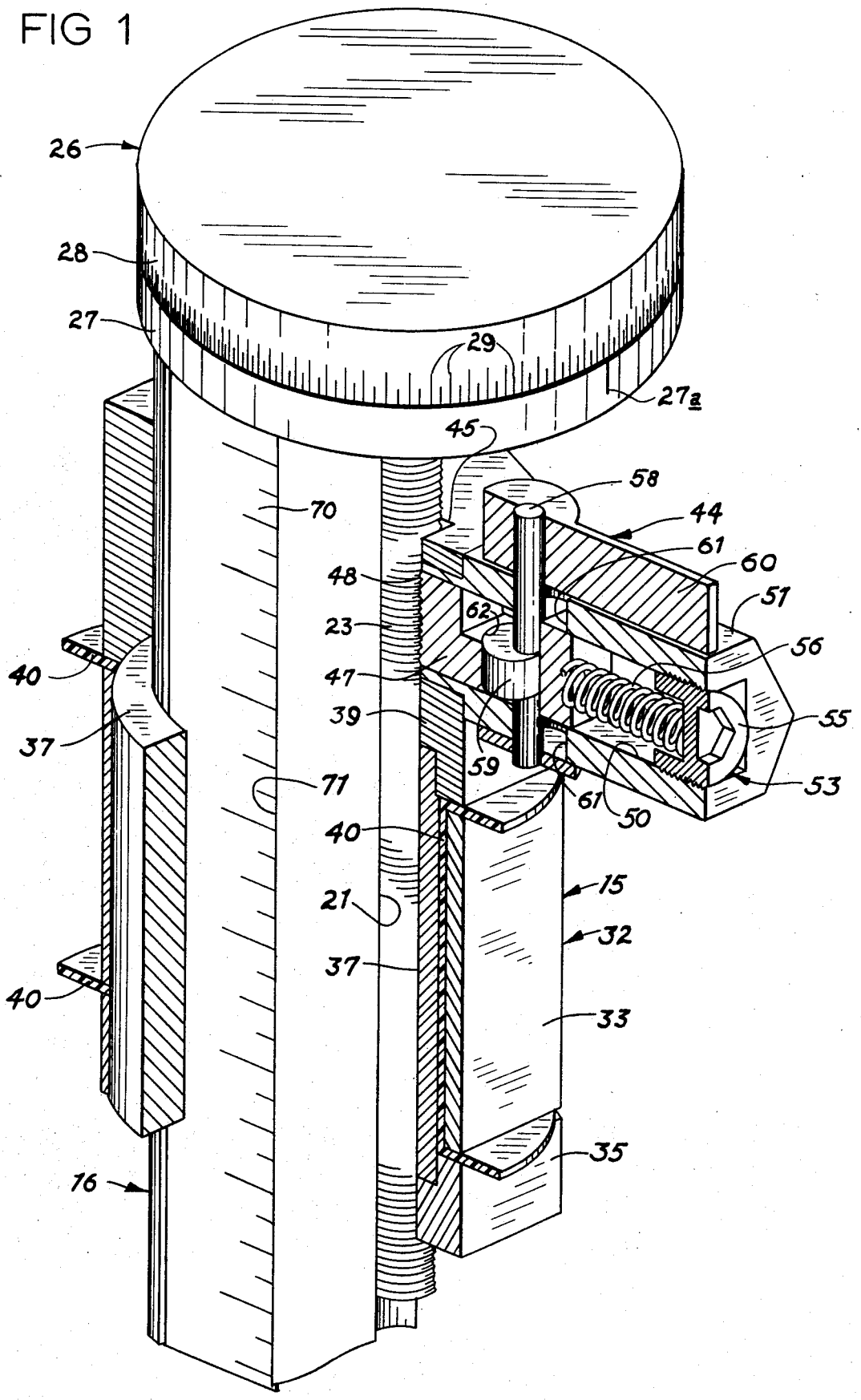
FIG. 1 is a fragmentary pictorial view of the present invention.

Referring now to the drawings and especially to FIG. 2, a faceting machine is generally indicated therein by the reference numeral 10. Faceting machine 10 includes the improved adjustable faceting head support assembly 15 of the present invention for precisely adjusting the height of a gem 12 from a lap 13 while allowing pivotal movement of the gem in a horizontal plane.

Faceting machine 10 includes a horizontal base 14 that mounts lap 13 for powered rotation in a fixed plane. Gem 12 is held above the lap 13 by a faceting head 11 that is pivotably mounted to the present improved support assembly 15. Planar facets of predetermined size and angular relationship may be cut about gem 12 as it is held against the rotating lap 13. The angular position of each gem facet is determined by adjustments provided on the faceting head 11 mounted to the present support assembly 15. The depth of cut is controlled by positioning the faceting head 11 elevationally along an upright mast 16 by slidably moving the support assembly thereon. More precise adjustment of the elevation is accomplished through the present improvement by rotating a lead screw 23 against a half nut means 43 (described in greater detail below). The mast 16 is mounted to base 14 in an upright condition with its central axis extending vertically between a lower mast end 19 and an upper mast end 20. A longitudinal groove 21 is provided along mast 16, extending parallel to the central mast axis substantially the full length of the post. Groove 21 is semi-circular in cross section, complementary to the circular cross section of lead screw 23 which it loosely receives therein. Lead screw 23 is rotatable within groove 21 about a vertical axis parallel to the central axis of mast 16.

Rotation of lead screw 23 may be accomplished manually through a rotating means 26 provided at an upper lead screw end 25. Means 26 includes a knob base 27 fixed to mast 16 and a knob 28 fixed to lead screw 23 and rotatable relative to knob base 27. Knob base 27 includes an indicator mark 27*a* that cooperates with a set of indicia 29 spaced about the circular periphery of knob 28.

Lead screw 23 and mast 16 are partially encircled by a collar means generally shown at 32. Collar means 32 includes a faceting head mounting sleeve 33 rotatably mounted to a bushing member 37. Sleeve 33 is prevented from moving vertically along bushing member 37 by first and second collar members 35 and 29. First collar member 35 is either formed integrally with or press fitted to the lower end of bushing member 37. Second collar member 39 is similarly fitted to the upper end of bushing member 37 to thereby locate the faceting head mounting sleeve 33 therebetween. Bearing means is provided by way of an insert 40 between the bushing member 37, first and second collars 35 and 39, and sleeve 33. Collar means 32 includes an inwardly facing longitudinal slot 45 for loosely receiving the exposed portion of lead screw 23.

A friction adjusting means 34 (FIG. 5) is provided to enable selective adjustment of rotational resistance of sleeve 33 about bushing member 37. Frictional adjusting means 34 includes a longitudinal slot 41 formed through sleeve 33. A vertically spaced pair of set screws 42 threadably engage the sleeve 33 on one side of the slot 41 with their heads on the opposite side to enable a selective amount of compressive force to be applied to bushing member 37 by selectively adjusting screws 42.

In describing half nut means 43 in greater detail, reference is made in particular to FIGS. 1, 3, and 4. The half nut means 43 is moved relative to screw 23 through an actuator means 44 that is also shown in some detail in these figures. Half nut means 43 is comprised of a polygonal block 47 having a semicircular threaded recess 48 therein that is complementary to the threaded peripheral surface of lead screw 23. Block 47 is slidably held within a complementary bore 50 formed within a protruding channel member 51 on collar means 32. Bore 50 is positioned perpendicular to the parallel axis of the mast 16 and lead screw 23.

An adjustable biasing means 53 is provided within channel member 51 to urge block 47 continuously toward lead 23. Biasing means 53 is comprised of a plug 55 that is threadably engaged within an outer end of bore 50. A compression spring 56 is positioned between plug 55 and block 47. Selective adjustment of plug 55, by turning it within the threaded portion of channel member 51, will produce varying amounts of force (through spring 56) against the block 47.

Half nut means 43 may be selectively moved between a position wherein the threaded recess 48 is threadably engaged with lead screw 23 (FIG. 3), and a disengaged position as shown in FIG. 4. This positioning is accomplished manually through actuator means 44. Means 44 is comprised of an eccentric rod 58 that extends through channel member 51 to mount a circular cam 59 within bore 50. A knob 60 is provided on an upper end of rod 58 to permit selective manual positioning of the rod and to support the rod within channel member 51. An upright bore 61 is formed through channel member 51 of a diameter substantially equal to that of the circular cam 59. A similar bore 62 is formed in polygonal block 47 of the same diameter. Bores 61 and 62 allow free rotation or rod 58 about their common center axes and enable unrestricted operation of biasing means 53 against half nut means 43 when engaged with lead screw 23. The polygonal cross sectional shape of block 47 and complementary shape of the receiving bore 50 prohibits rotational movement of the block 47. Therefore, the threaded recess 48 is always in an aligned condition for positive engagement and disengagement of the lead screw 23.

The collar means 32 is prevented from undesired pivotal movement about the mast 16 and lead screw 23 by a longitudinal guide means 64 (FIG. 5). Means 64 is basically comprised of a longitudinal flute 65 formed along mast 16 parallel to the central mast axis and diametrically opposed to groove 21. Guide members 66 are provided that are operatively connected to collar means 32 for movement within flute 65. As shown in FIG. 5, guide members 66 are spaced longitudinally within the flute 65 with one being connected to first collar member 35 and the remaining guide member being mounted to collar means 32 at the second collar member 39. Guide members 66 are urged into engagement with flute 65 by compression springs 67, slidably held within complementary bores 69 formed in collar means 32. Bores 69 are perpendicular to the central mast axis and include threaded plugs 68 threadably engaged therein. Compression springs 67 are positioned between the guide members 66 and plugs 68 to produce an inward force against the guide members 66 to hold them within flute 65. Force against guide members 66 may selectively be adjusted by moving threaded plugs 68 appropriately within bores 69. It is desirable to tighten the guide members 66 against mast 16 so they will offer sufficient resistance to longitudinal movement along the mast axis to prevent the collar means and faceting head from falling when the half nut and lead screw are disengaged.

In operation, the gem 12 may be roughly elevationally positioned relative to the lap 13 by first turning knob 60 to disengage block 47 from the lead screw 23. This enables relatively free longitudinal movement of the collar means 32 and faceting head 11 along the mast and lead screw. A scale 70 is fitted within a recess 71 in mast 16 to facilitate rough positioning of the faceting head at an approximate elevation over lap 13.

When the approximate elevation is located, the user may again turn the knob 60 to move half nut means 43 into engagement with lead screw 23. This serves to anchor the collar means and attached faceting head to the lead screw 23. Further elevational adjustment may then be accomplished by turning lead screw 23 through rotating means 26 at upper post end 20. Knob 28 may be rotated relative to its base 27 to align an appropriate increment mark 29 with the indicator 27*a* on base 27 to precisely locate the gem at a corresponding elevation relative to lap 13. Once this position is reached, a facet may be formed by holding the gem 12 against the lap surface 13. The gem 12 may be pivoted within a horizontal plane through provision of the bushing member 37 that rotatably journals the faceting head mounting sleeve 33.

It is understood upon reading the above detailed description with reference to the attached drawings, that various changes and modifications may have become evident without departing from the scope of my invention. It is therefore intended that only the following claims be taken as restrictions and limitations upon the scope of this invention.

What I claim is:

1. In a gem faceting apparatus of the type including a base; a powered horizontal lap rotatably mounted to the base; and a faceting head located above the lap for supporting a gem in a prescribed angular relationship to the lap; an improved adjustable faceting head support assembly for holding the faceting head at selected elevations above the lap, comprising:

an upright mast of generally circular cross section mounted to the base and extending along a central mast axis;

a longitudinal open groove formed along said mast parallel to said central mast axis;

an elongated lead screw nested in said groove and freely rotatable therein about an axis parallel to said central mast axis;

collar means transversely encompassing a longitudinal portion of said mast and lead screw for holding the lead screw against the mast and for free longitudinal sliding movement over the mast and lead screw along said central mast axis;

a faceting head mounting sleeve encompassing a longitudinal portion of said mast and lead screw and supported by the collar means clear of the lead screw for free 360° rotation thereon in a selected horizontal plane about said mast and lead screw;

half nut means mounted to said collar means for lateral movement thereon relative to said lead screw between (a) a first position threadably engaging said lead screw to enable sliding movement of the attached collar means and faceting head mounting sleeve along the central mast axis only in response to rotation of said lead screw about its axis and (b) a second position disengaged from the lead screw to enable free sliding movement of the collar means and faceting head mounting sleeve along the central mast axis over the mast and lead screw;

actuator means on said collar means operatively engaging said half nut means for enabling selective engagement of said lead screw and half nut means; and means for rotating said lead screw to locate the faceting head elevationally over the lap when said half nut means is engaged with said lead screw.

2. The improvement as set out by claim 1 further including guide means interconnecting said upright mast and collar means for preventing rotation of said collar about said mast and lead screw while permitting free relative longitudinal sliding movement thereof along said mast and lead screw.

3. The improvement as set out by claim 2 wherein said guide means is comprised of:

a longitudinal flute formed along said mast parallel to said central mast axis and diametrically opposed to said longitudinal open groove;

a guide member mounted to said collar means and engaging said flute; and a biasing spring mounted between said guide member and collar for urging said guide member toward said flute.

4. The improvement as set out by claim 1 wherein said collar means is comprised of:

a first collar member;

a bushing member extending upwardly over said lead screw and mast from said first collar;

a second collar member fixed to an upper end of said bushing member;

wherein said faceting head mounting sleeve is journaled on said bushing member between said first and second collar members for free rotation about the upright mast and lead screw.

5. The improvement as set out by claim 4 further including bearing means disposed between said faceting head mounting sleeve, said bushing member, and said first and second collar means.

6. The improvement as set out by claim 4 wherein said faceting head mounting sleeve includes rotational friction adjusting means enabling said sleeve to be selectively tightened about said bushing member.

7. The improvement set out by claim 1 further including:

adjustable biasing means for urging said half nut means against said lead screw when engaged therewith; and wherein said groove is complimentary in cross section to a portion of the circular cross section of said lead screw.

8. The improvement as set out by claim 7 wherein:

said half nut means is comprised of a polygonal block having a threaded recess therein for engaging complementary threads of said lead screw;

said polygonal block being slidably held within a complementary bore within said collar means;

said adjustable biasing means comprising a selectively movable plug located within said complementary bore spaced from said polygonal block; and a compression spring disposed between said polygonal block and said selectively movable plug.

* * * * *